US007806778B2

(12) United States Patent
Elmer

(10) Patent No.: US 7,806,778 B2
(45) Date of Patent: Oct. 5, 2010

(54) GOLF PUTTER

(76) Inventor: John Clement Elmer, 49 Greenvale Village, 36 Shongweni Road, Hillcrest (ZA) 3610

( * ) Notice: Subject to any disclaimer, the term of this patent is extended or adjusted under 35 U.S.C. 154(b) by 574 days.

(21) Appl. No.: 11/575,191

(22) PCT Filed: Sep. 29, 2005

(86) PCT No.: PCT/IB2005/002897

§ 371 (c)(1),
(2), (4) Date: Mar. 13, 2007

(87) PCT Pub. No.: WO2006/038077

PCT Pub. Date: Apr. 13, 2006

(65) Prior Publication Data

US 2007/0265109 A1 Nov. 15, 2007

(30) Foreign Application Priority Data

Oct. 1, 2004 (ZA) ..... 2004/7949

(51) Int. Cl.
*A63B 69/36* (2006.01)

(52) U.S. Cl. ..... 473/246; 473/248; 473/251; 473/252; 473/288

(58) Field of Classification Search ..... 473/244–248, 473/305–315, 288, 340–341, 251–252
See application file for complete search history.

(56) References Cited

U.S. PATENT DOCUMENTS

| | | | | |
|---|---|---|---|---|
| 2,932,515 | A * | 4/1960 | May | 473/248 |
| 4,194,739 | A | 3/1980 | Thompson | |
| 4,735,414 | A * | 4/1988 | Williams et al. | 473/248 |
| 4,815,740 | A * | 3/1989 | Williams et al. | 473/248 |
| 5,275,413 | A * | 1/1994 | Sprague | 473/337 |
| 5,390,919 | A * | 2/1995 | Stubbs et al. | 473/246 |
| 5,407,196 | A * | 4/1995 | Busnardo | 473/246 |
| 5,716,287 | A * | 2/1998 | Levocz et al. | 473/248 |
| 5,863,257 | A * | 1/1999 | Busnardo | 473/246 |
| 5,899,817 | A * | 5/1999 | Dunikoski | 473/314 |
| 5,997,409 | A * | 12/1999 | Mattson | 473/244 |
| 6,270,423 | B1 * | 8/2001 | Webb | 473/226 |
| 6,485,375 | B1 * | 11/2002 | McKinley | 473/245 |
| 6,663,497 | B2 * | 12/2003 | Cameron | 473/245 |
| 7,204,765 | B2 * | 4/2007 | Cover et al. | 473/244 |

(Continued)

FOREIGN PATENT DOCUMENTS

EP 1592484 A 11/2005

*Primary Examiner*—Sebastiano Passaniti
(74) *Attorney, Agent, or Firm*—David A. Guerra

(57) ABSTRACT

The invention relates to a putter head for a golf putter and to a golf putter that includes the putter head and a putter shaft secured to the putter head. The putter head includes a first head part, that defines the striking face of the putter, and a second head part that is located operatively rearwardly of the first head part and that is displaceable on guide rods with respect to the first head part along a line extending substantially perpendicularly to the striking face defined by the first head part. Securing screws displaceable within the second head part can engage the respective guide rods for securing the location of the head parts with respect to one another. A shaft securing formation is associated with the first head part and permits securing of a putter shaft to the putter head in different angular configurations with respect thereto.

18 Claims, 7 Drawing Sheets

U.S. PATENT DOCUMENTS 7,410,423 B2 * 8/2008 Pinder ..... 473/244
7,416,494 B2 * 8/2008 Edel ..... 473/288
2003/0060301 A1 * 3/2003 Hsu ..... 473/248

* cited by examiner

GOLF PUTTER

CROSS-REFERENCE TO RELATED APPLICATIONS

This application is an U.S. national phase application under 35 U.S.C. §371 based upon co-pending International Application No. PCT/IB2005/002897 filed on Sep. 29, 2005. Additionally, this U.S. national phase application claims the benefit of priority of co-pending International Application No. PCT/IB2005/002897 filed on Sep. 29, 2005 and South Africa Application No. 2004/7949 filed on Oct. 1, 2004. The entire disclosures of the prior applications are incorporated herein by reference. The international application was published on Apr. 13, 2006 under Publication No. WO 2006/038077.

BACKGROUND OF THE INVENTION

1. Field of the Invention

THIS INVENTION relates to a golf putter.

2. Description of Related Art

A golf putter, which is the golf club commonly used on a putting green when playing golf for striking a golf ball towards a hole in the green, conventionally includes a head and an elongate shaft having one end secured to the head and extending from the head. The head defines a striking face and by gripping the putter via a grip, usually located on the shaft adjacent the free end thereof, the putter can be displaced to strike a golf ball via the striking face of the head towards a hole in a putting green. Insofar as the general configuration of a putter and the modes of use thereof are well known, these aspects are not described further herein.

However, insofar as the invention relates particularly to a putter head for a golf putter, any reference to such a head must be interpreted as a reference to a body that defines the striking face at the operative leading end thereof, with the remainder of the body extending operatively rearwardly from this striking face. The striking face particularly extends between a toe end of the putter head, which is the end operatively remote from a golfer when using the putter head as part of a putter, and a heel end, which is the end of the putter head proximate a golfer when using the putter head as part of a putter. The shaft of the golf putter can extend from any suitable location on the putter head, the putter head generally defining a formation that projects therefrom and that is configured to have a shaft operatively secured thereto.

It is well known that different putters are associated with different characteristics in terms of mass, mass distribution, alignment, shaft configuration, and the like, and that golfers have different requirements in this regard. A golfer, therefore, often finds it difficult to find a putter that meets all his requirements, particularly in the long term when such requirements may change, and it is thus an object of this invention to at least alleviate this problem, both in relation to putter head requirements and the requirements of a shaft to be associated therewith.

BRIEF SUMMARY OF THE INVENTION

According to the invention there is provided a putter head for a golf putter, which includes: a first head part that defines the striking face of the putter; a second head part that is located operatively rearwardly of the first head part in a configuration in which it is displaceable with respect to the first head part along a line extending substantially perpendicularly to the striking face defined by the first head part; securing means for releasably securing the location of the head parts with respect to one another; and a shaft securing formation for securing a shaft to the putter head.

According to a preferred embodiment of the invention, the putter head includes guide means that guides the displacement of the head parts with respect to one another along the line extending substantially perpendicularly to the striking face defined by the first head part. As such, the guide means may include a pair of parallel, spaced guide rods, each guide rod having one end secured in the first head part of the putter head and extending rearwardly from the first head part along a line parallel to the line extending substantially perpendicularly to the striking face defined by the first head part, the second head part being slidably located on the guide rods via guide passages defined therethrough.

For the above configuration guide means, the securing means may include a securing screw for each guide rod, each screw being displaceable within the second head part into abutment with its guide rod for securing the location of the second head part on the guide rods. More particularly, each guide rod defines a set of peripheral grooves within a segment along the length thereof, each groove being engagable by the end of a securing screw for locating the second head part on the guide rods in different locations and for providing a mechanical lock between the guide rods and the securing screws that lock the position of the second head part on the guide rods.

Still further for the above configuration guide means, the end of each guide rod may screw into the first head part via complementary screw formations. It will thus be understood that the guide rods are separable from the putter head, permitting the guide rods to be interchanged with another pair of guide rods which typically are associated with different characteristics, e.g. mass characteristics, in order to provide the putter head with different mass characteristics. The putter head accordingly may include at least one additional pair of guide rods that is interchangeable with the pair of guide rods that serve as the guide means.

The shaft securing formation of the putter head may be a formation located on the first head part. A particular embodiment of the putter head hence provides for the first head part to define a rear face that is substantially parallel to and spaced operatively rearwardly from the striking face, the shaft securing formation being located within the first head part on the rear face side thereof, the second head part being profiled to permit securing of a shaft to the first head part via the said securing formation for any position of the second head part with respect to the first head part.

The securing formation may permit releasable engagement of a shaft with the first head part via a complementary formation provided at the end of the shaft to be secured to the first head part. As such, the securing formation and the complementary formation provided at the end of a shaft to be secured to the first head part may include an adjustment arrangement for adjusting the angle between the shaft and the first head part about an axis parallel to the said line extending substantially perpendicularly to the striking face defined by the first head part. The adjustment arrangement particularly permits adjustment of the said angle between the shaft and the first head part and about the said axis between positions that will permit use of a putter including the putter head by a golfer that putts left handed and by a golfer that putts right handed.

Further according to the invention, the complementary formation referred to may be a formation provided as part of the putter head and the complementary formation may thus permit securing of any selected shaft thereto. Insofar as the complementary formation may permit different shafts to be secured thereto, securing of, for example, different length shafts to the putter head is conveniently accommodated.

Still further according to the invention, the second head part of the putter head may be profiled to define formations that can facilitate putter alignment during use thereof. Formations associated with putter heads for this purpose are already well known and, as such, suitable formations for the above purpose are not defined further herein.

The first head part and the second head part of the putter head may be displaceable between a position in which the two parts abut one another and a plurality of positions in which the parts are spaced from one another. Thereby, the mass distribution within the putter head can be conveniently adjusted for accommodating particular golfer requirements.

Still further, the first head part may have an insert formation located therein that defines the striking face thereof. Once again, different golfer requirements may thereby be accommodated.

The putter head of the invention may be associated also with various other formations and features that are commonly associated with conventional putters in order to accommodate particular putter requirements.

The invention extends also to a putter which includes: a putter head including a first head part that defines the striking face of the putter; a second head part that is located operatively behind the first head part in a configuration in which it is displaceable with respect to the first head part along a line extending substantially perpendicularly to the striking face defined by the first head part; securing means for releasably securing the location of the head parts with respect to one another; and a shaft securing formation for securing a shaft to the putter head; and a putter shaft having one end secured to the putter head via the shaft securing formation thereof and having a grip located on the other end thereof.

The putter head of the golf putter of the invention particularly includes all the features of the putter head, in accordance with the present invention.

Insofar as the putter head may include a complementary formation that can cooperate with the shaft securing formation for securing a shaft to the putter head, the shaft of the putter may be replaceably secured to the complementary formation of the putter head to be interchangeable with different length putter shafts.

BRIEF DESCRIPTION OF THE SEVERAL VIEWS OF THE DRAWINGS

Further features of the invention, including the benefits associated with the invention, are described in more detail hereinafter with reference to an example of a putter head, in accordance with the invention, which is illustrated in the accompanying diagrammatic drawings. In the drawings.

DETAILED DESCRIPTION OF THE INVENTION

Figure 1:
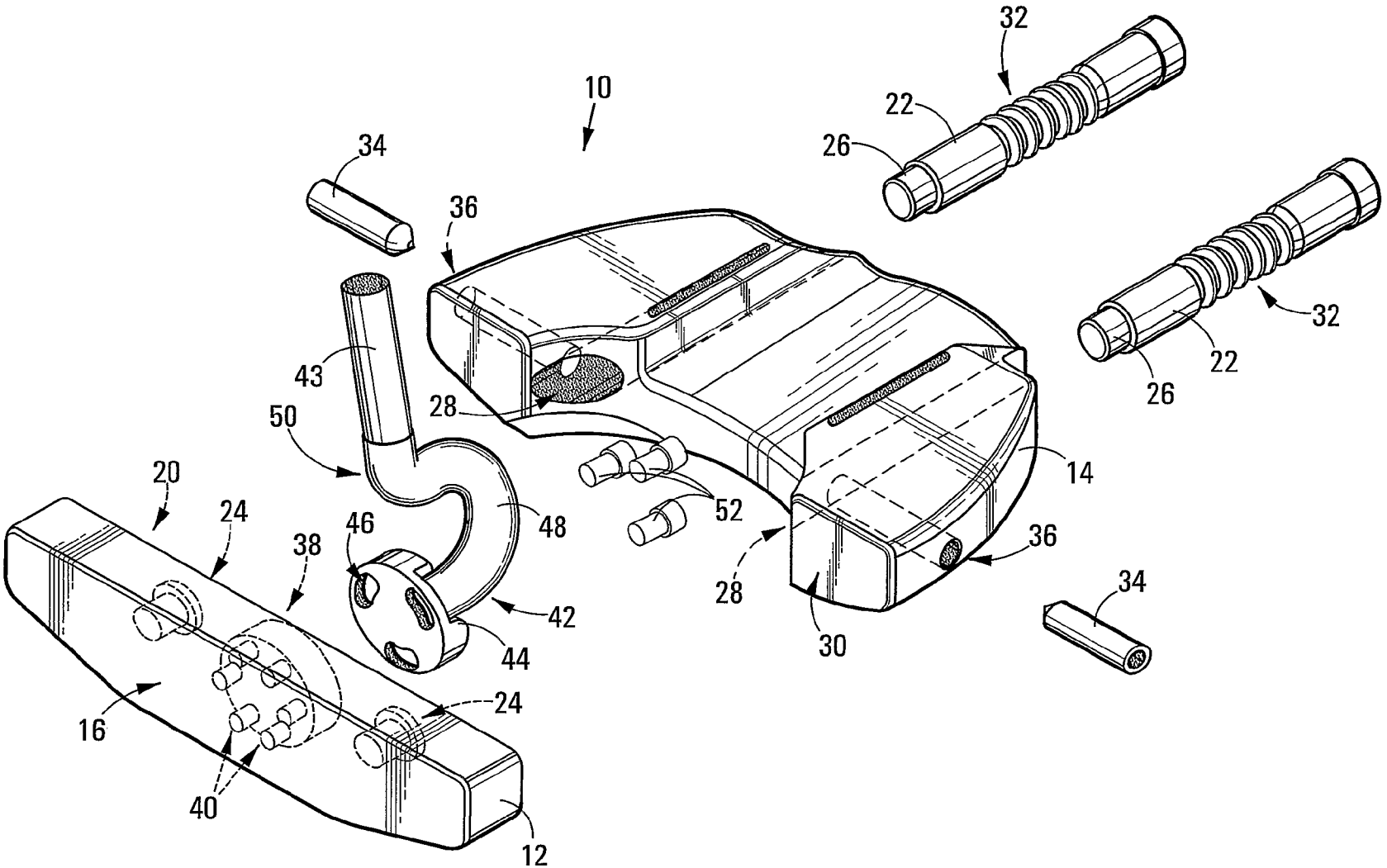
FIG. 1 shows an exploded three-dimensional view of a putter head for a golf putter, in accordance with the invention.

Referring initially to FIGS. 1 to 6 of the drawings, a putter head for a golf putter, in accordance with the invention, is designated generally by the reference numeral 10. The putter head 10 includes a first head part 12 and a second head part 14, the two head parts being displaceably located with respect to one another in a configuration as described hereafter.

The first head part 12 defines the striking face 16 of the putter head that, as for conventional putters, is a substantially planar face. This striking face 16 forms the operative leading face of the putter head, whereby a golf ball is struck when performing a putting stroke.

The first head part 12 defines also a rear face 20, that is disposed parallel to and rearwardly spaced from the striking face 16. Two elongate guide rods 22 serve to guide displacement of the second head part 14 with respect to the first head part 12 as described hereafter, particularly along a line extending substantially perpendicularly to the striking face 16 defined by the first head part 12. More particularly, the first head part 12 defines two threaded bores 24 on the operative rear face side 20 thereof, the guide rods 22 defining threaded leading ends 26 that can operatively screw into the respective bores 24. When screwed into the bores 24, the guide rods 22 will be axially aligned with the said line extending substantially perpendicularly to the striking face 16 defined by the first head part 12.

The second head part 14 is slidably located on the guide rods 22 via suitable guide passages 28 that are defined therethrough, thus providing for sliding displacement of the second head part 14 on the guide rods 22. The two head parts particularly are displaceable with respect to one another between a first position, in which the operative front face 30 of the second head part 14 abuts against the operative rear face 20 of the first head part 12 and a plurality of positions in which the two head parts are spaced apart (see respectively FIGS. 5 and 6 of the drawings).

Figure 2:
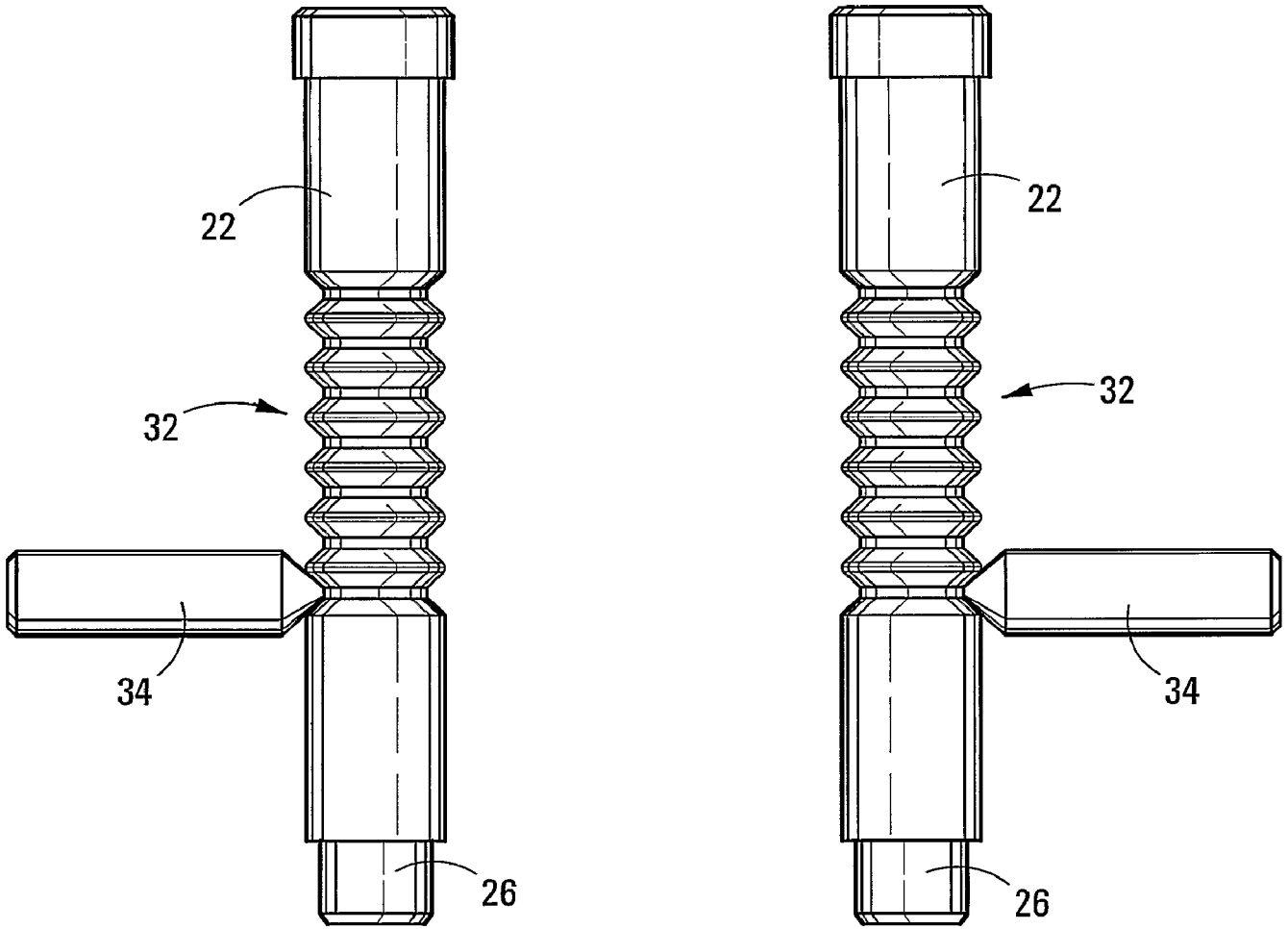
FIG. 2 illustrates in plan view the operation of the guide rods and securing screws of the putter head of FIG. 1.

As is clearly illustrated in FIG. 2 of the drawings, each guide rod 22 defines a set of peripheral grooves 32 therein along a segment of the length thereof. The putter head 10 includes also two securing screws 34, each screw being displaceable in a complementary threaded passage 36 defined therefor within the second head part 14, so that the leading end of the securing screw 34 can be displaced into abutment with one of the guide rods 22 and particularly into mechanical engagement with one of the peripheral grooves 32 in the guide rod 22. As such, the second head part 14 can be mechanically locked in different positions with respect to the first head part 12, with its position being determined by the location of the peripheral grooves 32 with respect to the securing screws 34, i.e. being determined by the position of the second head part 14 on the guide rods 22.

Figure 3:
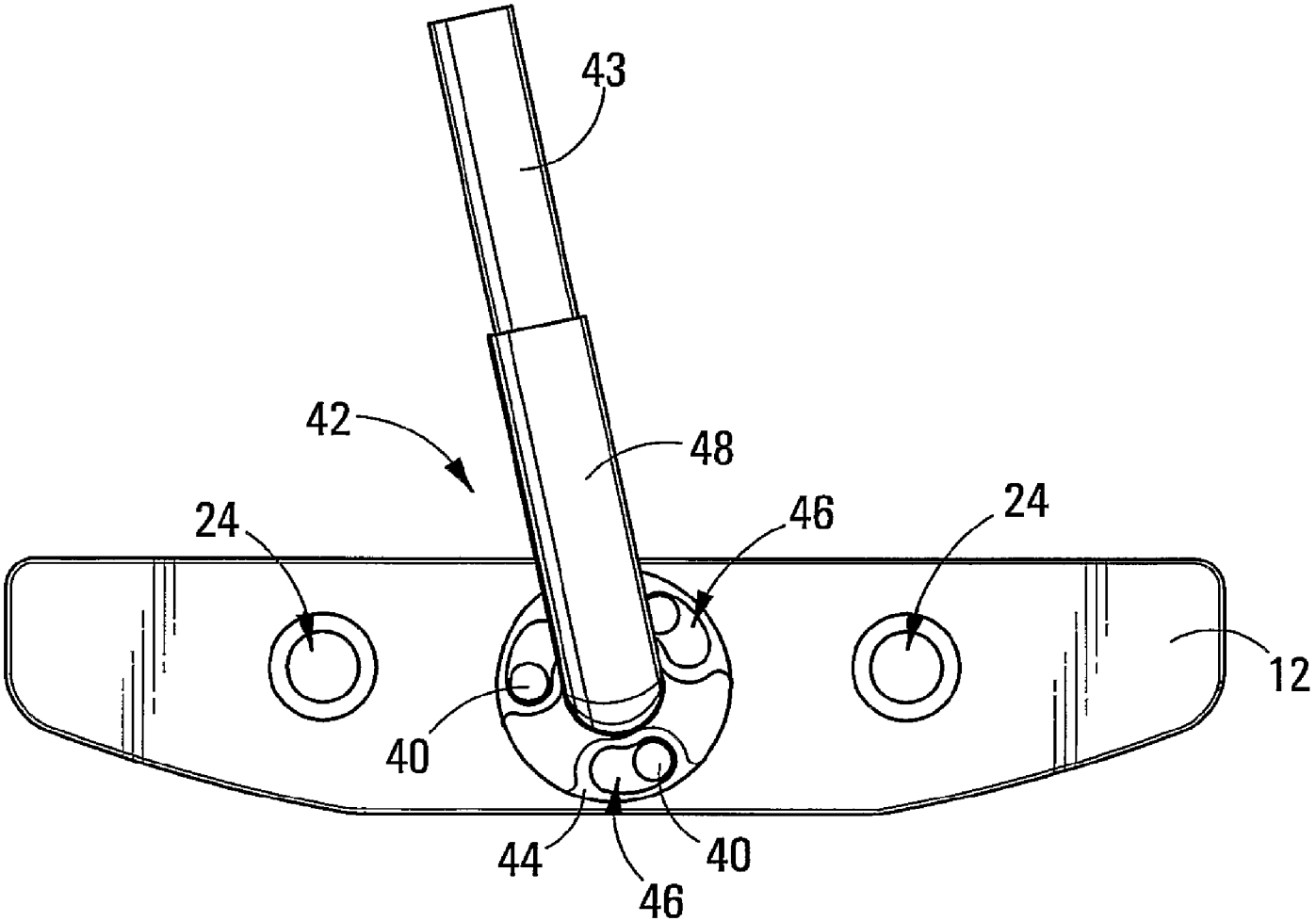
FIG. 3 illustrates in rear end view the mode of securing a putter shaft to the first head part of the putter head of FIG. 1, with the shaft disposed in a first optional configuration thereof.
Figure 4:
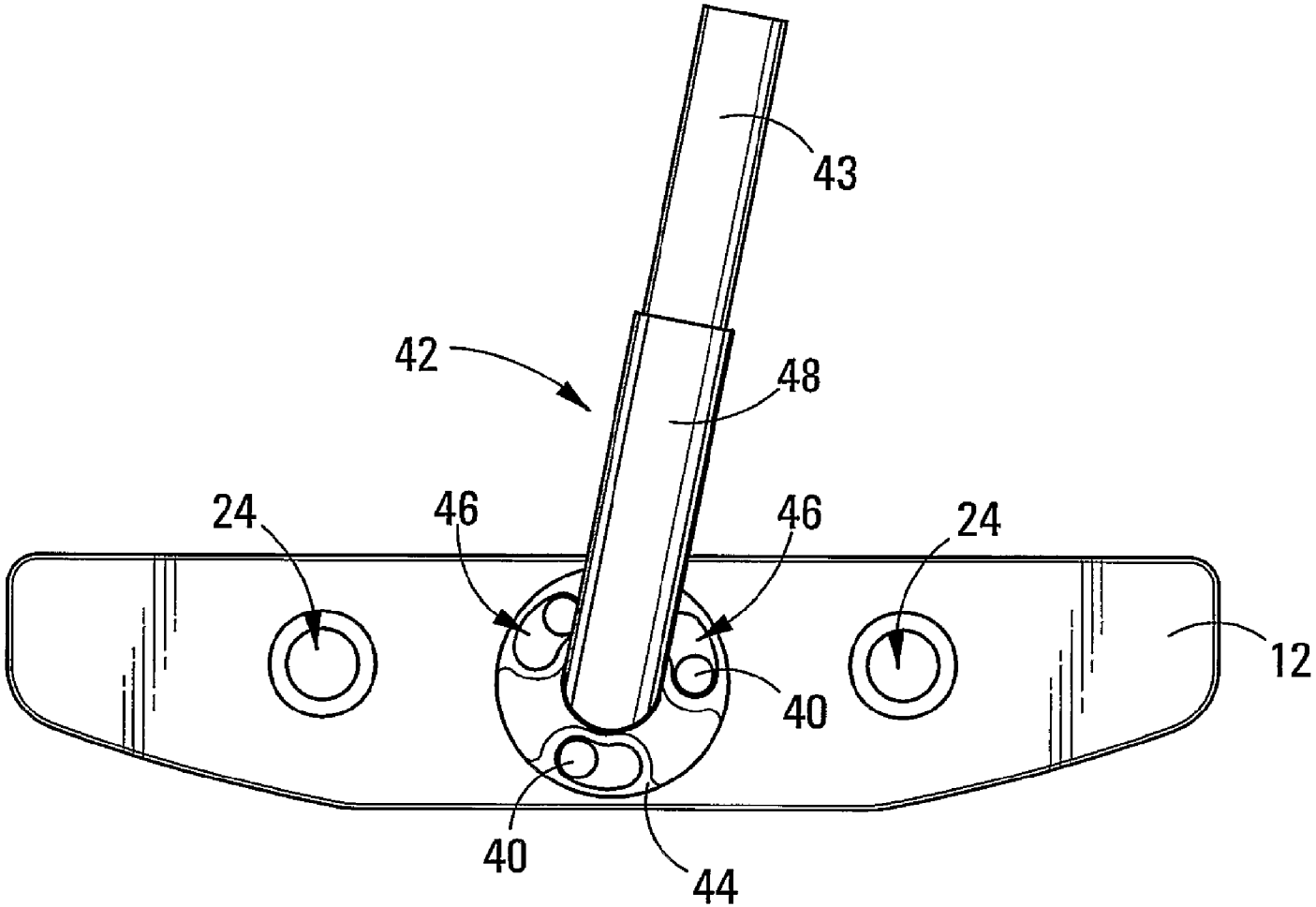
FIG. 4 illustrates in rear end view the putter shaft and the first head part of the putter head as shown in FIG. 3, with the shaft disposed in a second optional configuration thereof.

Referring particularly also to FIGS. 3 and 4 of the drawings, the first head part 12 of the putter head 10 has a shaft securing formation, for securing a shaft to the putter head, formed within the rear face 20 thereof. The shaft securing formation includes particularly a circular recess 38 which is located midway between opposite ends of the first head part 12 and two sets of three equally spaced threaded bores 40, extending further into the first head part 12 from the base of the recess 38.

The putter head 10 includes further a complementary formation 42 that can cooperate with the formation 38 for securing a putter shaft (not shown) to the putter head 10. The complementary formation 42 includes a circular disc-like body 44 that rotatably fits into the circular recess 38 and that has three slot-like apertures 46 formed therein that will be disposed in register with one of the sets of threaded apertures 40 in different angular positions of the body 44 within the recess 38, as is described in more detail hereafter.

The disc-like body 44 has a shaft engagement formation 48 extending therefrom as shown, the shaft engagement formation 48 defining a spigot formation 43 at the end 50 thereof which is configured to receive the end of a putter shaft (not shown) thereon and which will permit a putter shaft to thereby be secured to the putter head 10. The mode in which a putter shaft is secured to the shaft engagement formation 48 via the spigot formation 43 is conventional as for known putters. A putter shaft is thus secured to the shaft engagement formation 48 in a configuration in which it remains separable therefrom, in order to permit replacement with a different shaft.

Referring now particularly to FIG. 3 of the drawings, with the shaft engagement formation 48 orientated with respect to the first head part 12 in the configuration as shown, the shaft engagement formation 48 can be secured to the first head part 12 by means of three securing screws 52 that can screw into one of the sets of threaded bores 40 and engage the disc-like body 44, to thereby secure its location with respect to the first head part 12. As is clear from the drawing, by the angular displacement of the shaft engagement formation 48 between limits determined by the slot-like apertures 46 defined in the body 44, the angular position of the shaft engagement formation 48 and, therefore, a shaft secured thereto, can be adjusted, thus to accommodate particular golfer requirements. The limits of adjustment particularly are determined by formal rules that are associated with the design of golf putters and that require there to be a particular angular relationship between the shaft of a golf putter and its associated putter head.

The angular relationship between a putter shaft secured to the shaft engagement formation 48 and the first head part 12 of the putter head 10 as shown in FIG. 3 particularly accommodates putting by right handed golfers. In order to accommodate putting by left handed golfers, the shaft engagement formation 48 can be displaced to a range of angular positions as determined by the slot-like apertures 46 in relation to their position with respect to the second set of threaded bores 40, the mode of angular adjustment of the shaft engagement formation 48 and, therefore, of a shaft, with respect to the first head part 12, being effected merely by loosening and fastening of the securing screws 52. The particular relationship between the slot-like apertures 46 and the two sets of threaded bores 40 is such that only "legal" angular relationships are permitted, as determined by the formal rules that are associated with the design of golf putters, although accommodating particularly both left handed and right handed golfers.

Figure 5:
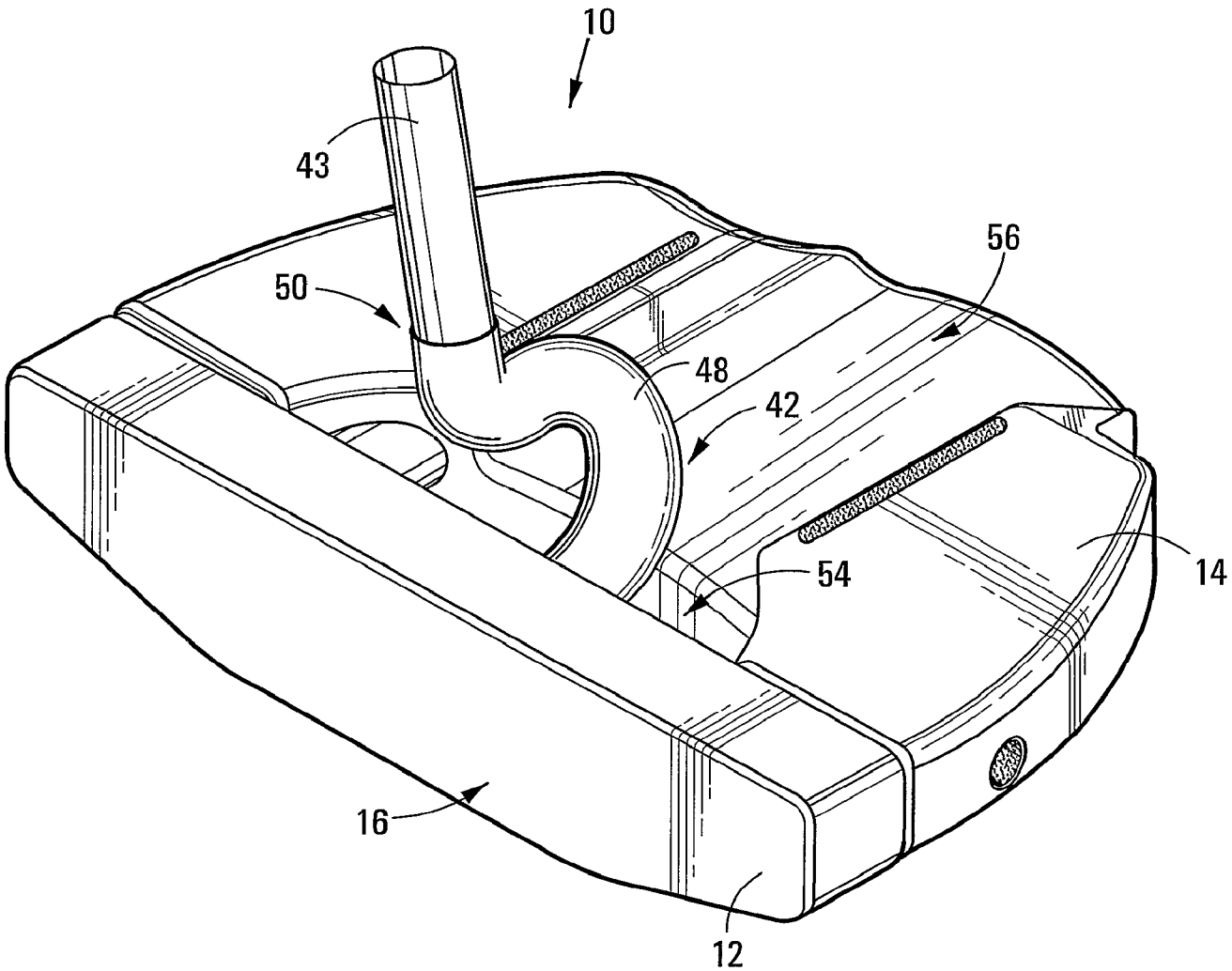
FIG. 5 shows in three-dimensional view the putter head of FIG. 1 in an assembled configuration thereof, with the first head part and the second head part of the putter head in a first operative configuration thereof.
Figure 6:
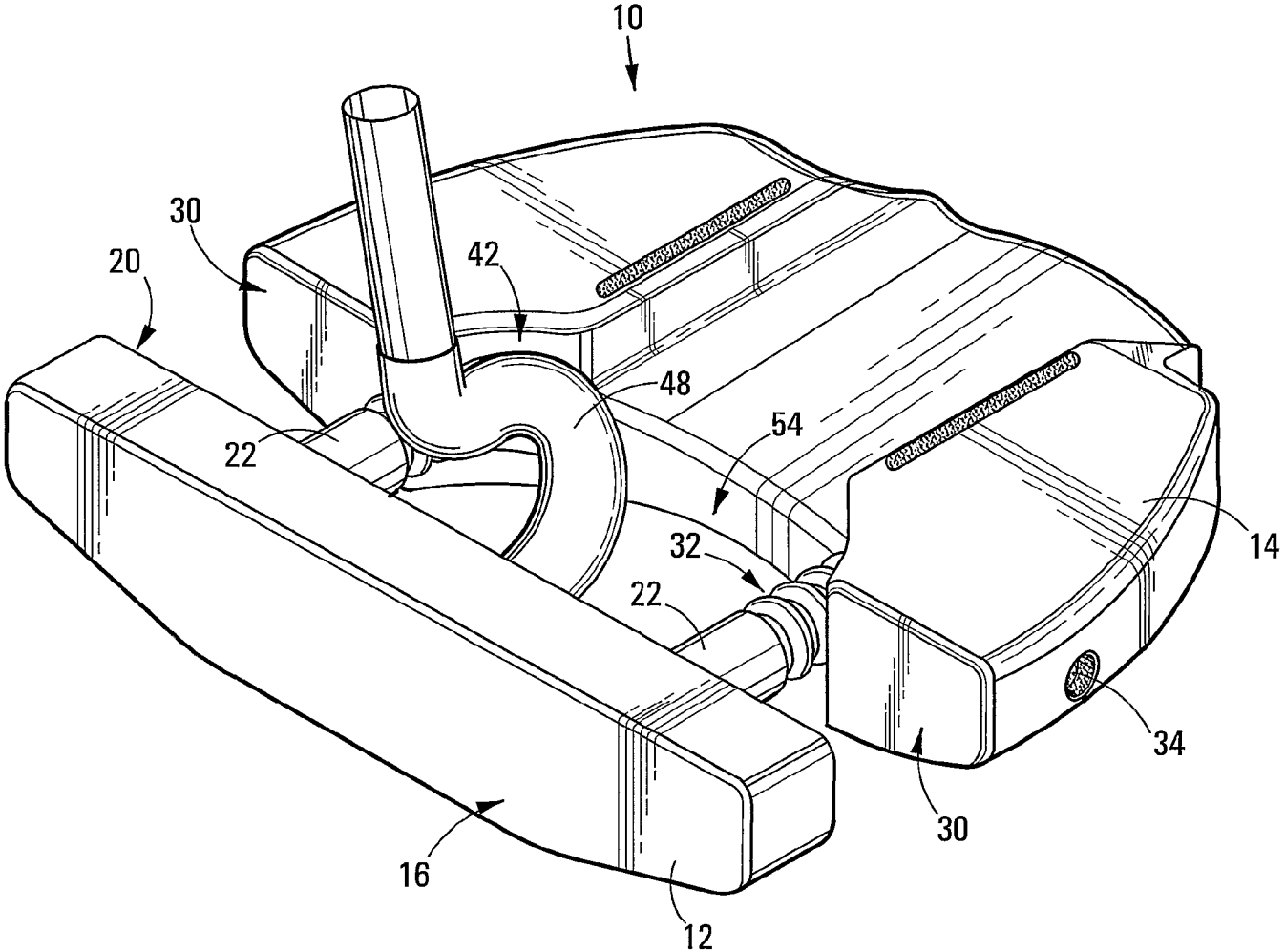
FIG. 6 shows in three-dimensional view the putter head as shown in FIG. 5, but with the first head part and the second head part thereof disposed in a second operative configuration thereof.

As is clearly illustrated particularly also in FIGS. 5 and 6 of the drawings, the second head part 14 of the putter head 10 is profiled to define a space 54 between the two head parts, 12 and 14, which space is disposed centrally behind the centre of the first head part 12 and which thus serves to accommodate the location of the shaft engagement formation 48 with respect to the putter head. The space 54 also is located centrally behind the centre of percussion defined by the striking face 16 as referred to above, this space thus serving also to provide for a desired mass distribution of the second head part 14 behind the first head part 12.

Insofar as the overall mass and the mass distribution associated with a putter head is considered very important to particular golfers, the displacement of the first head part 12 and the second head part 14 of the putter head 10 serves to accommodate various such requirements. It is further envisaged in this regard that the putter head 10 may be provided with additional pairs of guide rods that are selectively interchangeable with the guide rods 22, the additional guide rods being formed of different materials and of a different mass, so that through interchanging guide rods, further requirements of particular golfers can be accommodated. Although it is envisaged that a particular pair of guide rods used would usually have the same mass, it is envisaged in this regard that a pair of guide rods can be used where the rods have a different mass to one another, thus altering the mass distribution on the operative toe end and heel end of the putter head. In practice, this can reduce a tendency by a golfer to either push/slice a putt or to pull/hook a putt.

The second head part 14 of the putter head 10 further is profiled to accommodate the alignment of the putter head when used as a putter, i.e. with a shaft secured thereto, in order to strike a ball in a desired direction. The channel formation 56 defined in the operative top face side of the second head part 14 is particularly configured and directed for this purpose.

Particularly in relation to the adjustment of the spacing between the first head part 12 and the second head part 14 of the putter head 10, it is envisaged that by increasing the spacing between the two head parts, the mass distribution within the putter head can be adjusted to induce a golf ball to be displaced with a very slight upward trajectory to induce effective roll of a ball on a putting green, clearly as determined also by the putting stroke that is employed by the associated golfer.

By accommodating interchanging of putter shafts, it will be understood that particularly different length and/or different mass putter shafts can be associated with the putter head 10, which again can accommodate the requirements of different golfers and also allow a particular golfer to interchange shafts from time to time and as may be required by him.

Figure 7:
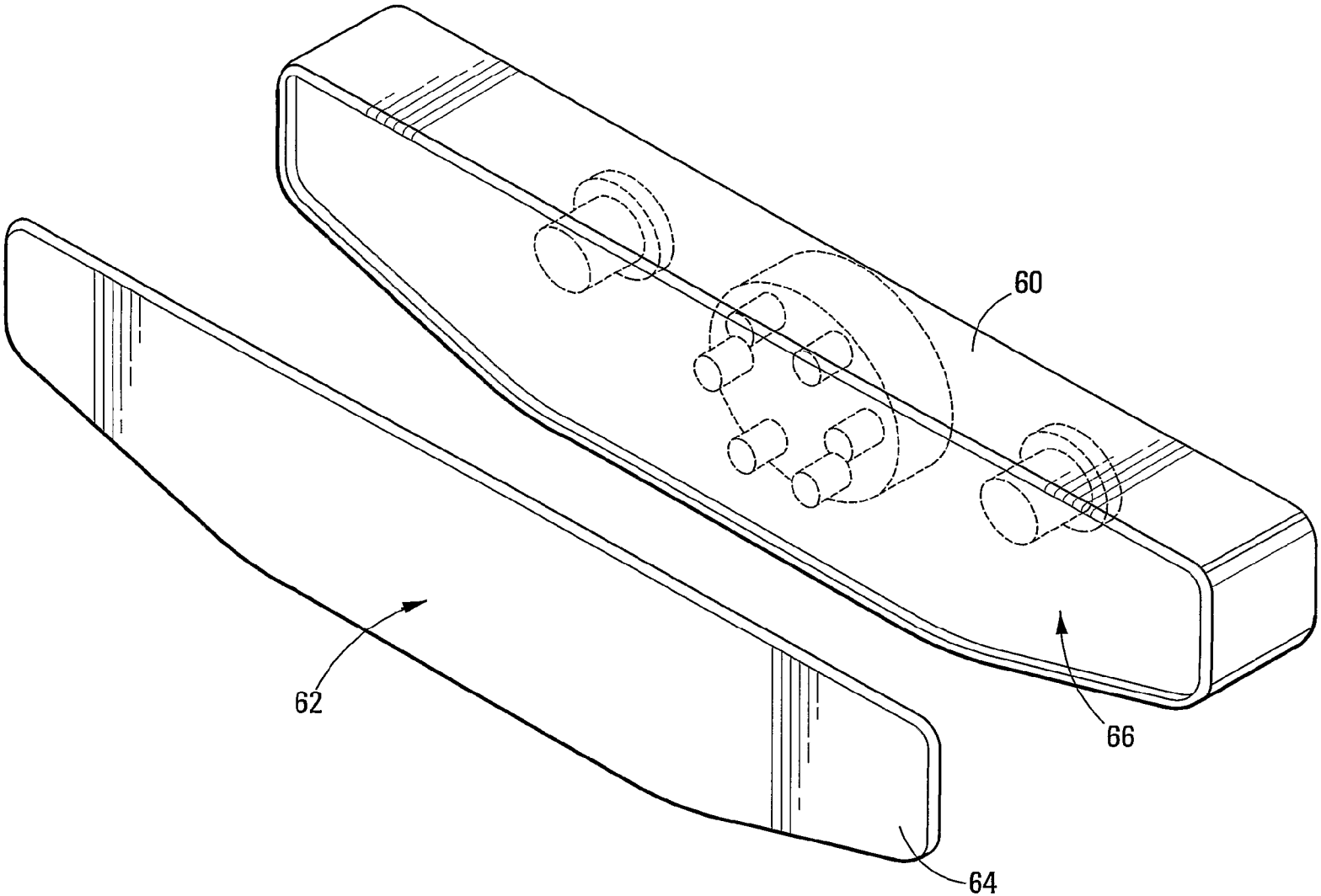
FIG. 7 shows a three-dimensional view of an alternative embodiment first head part for the putter head as shown in FIG. 1.

The putter head of the invention further may be associated with various other features that are commonly associated with known putters in order to provide a putter with different putting characteristics, it being envisaged, for example, that either one or both parts of the putter head can be associated with removable mass inserts that can still further accommodate mass and mass distribution requirements of a golfer in relation to the putter head. Clearly, the two head parts of the putter heads can be formed of the same or different materials, while different configuration striking faces also can be provided for. For example, the striking face 16 of the first head part 12 of the putter head 10 as described is a milled face, whereas, as shown in FIG. 7 of the drawings, the first head part 60 of a putter head may have a striking face 62 defined by an insert element 64 that is located within a recess 66 provided therefor in the front face side of the first head part 60, the insert element providing the associated putter head with particular striking characteristics. Clearly, the putter head of the invention as described can accommodate numerous other requirements of a golfer in this regard.

It is envisaged that the putter head of the invention will ordinarily be provided together with two or more pairs of interchangeable guide rods as envisaged above, while a special tool or tools, e.g. Allen keys that can engage Allen sockets defined respectively in the operative trailing ends of the guide rods 32, of the securing screws 34 and of the securing screws 52, also may be provided in order to facilitate the assembly and required adjustments within the configuration of the putter head, as required from time to time, keeping in mind that it is a rule of golf that the characteristics of a putter head of a putter may not be changed within the course of a round of golf. The particular mechanical construction of the putter head as described clearly is such that without the use of the special tools, the mechanical configuration thereof is not adjustable in any way whatsoever, thus ensuring that contraventions of the said rule of golf cannot occur in practice.

It will further be appreciated that the overall design of the putter head of the invention is greatly variable and that within the principles of the invention as defined and described, many different configuration putter heads can be provided that can be associated with putter shafts that are secured in different locations and in different configurations. The invention extends to all such variations of putter heads for golf putters and golf putters including such putter heads, which still incorporate the essential principles of the invention as herein defined and described.

The invention claimed is:

1. A putter head system for a golf putter comprising:

a first head part that defines a striking face of a putter;

a second head part that is located operatively rearwardly of said first head part in a configuration in which it is displaceable with respect to said first head part along a line extending substantially perpendicularly to said striking face defined by said first head part;

a securing means for releasably securing the location of said first and second head parts with respect to one another;

a shaft securing formation for securing a shaft to said putter head; and a guide means that guides the displacement of said first and second head parts with respect to one another along the line extending substantially perpendicularly to said striking face defined by said first head part;

wherein said guide means includes at least two parallel, spaced guide rods, each guide rod having one end secured in said first head part of the putter head and extending rearwardly from said first head part along a line parallel to the line extending substantially perpendicularly to said striking face defined by said first head part, said second head part being slidably located on said guide rods via at least two guide passages defined therethrough;

wherein said securing means includes a securing screw for each said guide rod, each said securing screw being displaceable within said second head part into abutment with its respective said guide rod for securing the location of said second head part on said guide rods;

wherein each said guide rod defines a set of peripheral grooves within a segment along the length thereof, each said groove being engagable by an end of said securing screw for locating said second head part on said guide rods in different locations and for providing a mechanical lock between said guide rods and said securing screws that lock the position of said second head part on said guide rods.

2. The putter head as claimed in claim 1, wherein said first head part further comprises at least two screw formations located opposite said striking face of said first head part, each of said screw formations being adapted to threadably receive an end of said respective guide rod.

3. The putter head as claimed in claim 2 further comprising at least one additional pair of guide rods that is interchangeable with said guide rods that serve as a guide means.

4. The putter head as claimed in claim 3, wherein said additional guide rods are of different mass to the mass of said guide rods that serve as the guide means.

5. The putter head as claimed in claim 1, in which said shaft securing formation is located on said first head part.

6. The putter head as claimed in claim 5, wherein said first head part defines a rear face that is substantially parallel to and spaced operatively rearwardly from said striking face, said shaft securing formation being located within said first head part on said rear face side thereof, said second head part being profiled to permit securing of said shaft to said first head part via said securing formation for any position of said second head part with respect to said first head part.

7. The putter head as claimed in claim 6, wherein said securing formation permits releasable engagement of said shaft with said first head part via a complementary formation provided at an end of said shaft to be secured to said first head part.

8. The putter head as claimed in claim 7, wherein said securing formation and said complementary formation provided at said end of said shaft to be secured to said first head part include an adjustment arrangement for adjusting the angle between said shaft and said first head part about an axis parallel to the said line extending substantially perpendicularly to said striking face defined by said first head part.

9. The putter head as claimed in claim 8, wherein said adjustment arrangement permits adjustment of the angle between said shaft and said first head part and about said axis between positions that will permit use of a putter including said putter head by a golfer that putts left handed and by a golfer that putts right handed.

10. The putter head as claimed in claim 7, wherein said complementary formation is provided as part of said putter head and said complementary formation permits securing of a selected shaft thereto.

11. The putter head as claimed in claim 1, wherein said second head part is profiled to define formations that facilitate putter alignment during use thereof.

12. The putter head as claimed in claim 1, wherein said first head part and said second head part are displaceable between a position in which said first and second head parts abut one another and a plurality of positions in which said first and second head parts are spaced from one another.

13. The putter head as claimed in claim 1, wherein said striking face of said first head part is defined by an insert formation located therein.

14. A putter head system for a golf putter comprising:

a first head part that defines a striking face of a putter, and a rear face that is substantially parallel to and spaced operatively rearwardly from said striking face, said first head part having a shaft securing formation located within said first head part on said rear face side thereof for securing a shaft to said first head part, and at least two screw formations located in said rear face;

a second head part that is located operatively rearwardly of said first head part in a configuration in which it is displaceable with respect to said first head part along a line extending substantially perpendicularly to said striking face defined by said first head part, said second head part having at least two guide passages defined therethrough, said second head part being profiled to permit securing of said shaft to said first head part via said securing formation for any position of said second head part with respect to said first head part;

at least two parallel, spaced guide rods, each of said guide rods having a set of peripheral grooves within a segment along the length thereof, and an end threadably secured in said respective screw formation of said first head part of said putter head and extending rearwardly from said first head part along a line parallel to the line extending substantially perpendicularly to said striking face defined by said first head part, said second head part being slidably located on said guide rods via said guide passages defined through said second head part; and a securing means for releasably securing the location of said first and second head parts with respect to one another, said securing means having a securing screw for each said guide rod, each said securing screw being displaceable within said second head part into engagement with at least one of said guide rod grooves by an end of said securing screw for locating said second head part on said guide rods in different locations and for providing a mechanical lock between said guide rods and said securing screws that lock the position of said second head part on said guide rods.

15. A golf putter system comprising:

a putter head having a first head part that defines a striking face of said putter, a second head part that is located operatively behind said first head part in a configuration in which it is displaceable with respect to said first head part along a line extending substantially perpendicularly to said striking face defined by said first head part, and a securing means for releasably securing the location of said first and second head parts with respect to one another, a shaft securing formation, and a guide means that guides the displacement of said first and second head parts with respect to one another along the line extending substantially perpendicularly to said striking face defined by said first head part; and a putter shaft having one end secured to said putter head via said shaft securing formation thereof, said putter shaft having a grip located on an end opposite thereof;

wherein said shaft securing formation permits releasable engagement of said putter shaft with said first head part via a complementary formation provided at an end of said shaft to be secured to said first head part, and wherein said putter shaft is replaceably secured to said complementary formation of said putter head to be interchangeable with different length putter shafts;

wherein said guide means includes at least two parallel, spaced guide rods, each guide rod having one end secured in said first head part of the putter head and extending rearwardly from said first head part along a line parallel to the line extending substantially perpendicularly to said striking face defined by said first head part, said second head part being slidably located on said guide rods via at least two guide passages defined therethrough;

wherein said securing means includes a securing screw for each said guide rod, each said securing screw being displaceable within said second head part into abutment with its respective said guide rod for securing the location of said second head part on said guide rods;

wherein each said guide rod defines a set of peripheral grooves within a segment along the length thereof, each said groove being engagable by an end of said securing screw for locating said second head part on said guide rods in different locations and for providing a mechanical lock between said guide rods and said securing screws that lock the position of said second head part on said guide rods.

16. The putter head as claimed in claim 15, wherein said securing formation and said complementary formation provided at said end of said shaft to be secured to said first head part include an adjustment arrangement for adjusting the angle between said shaft and said first head part about an axis parallel to the said line extending substantially perpendicularly to said striking face defined by said first head part.

17. The putter head as claimed in claim 16, wherein said adjustment arrangement permits adjustment of the angle between said shaft and said first head part and about said axis between positions that will permit use of a putter including said putter head by a golfer that putts left handed and by a golfer that putts right handed.

18. The putter head as claimed in claim 17, wherein said complementary formation is provided as part of said putter head and said complementary formation permits securing of a selected shaft thereto.

* * * * *